United States Patent [19]

Jordá

[11] Patent Number: 4,753,538

[45] Date of Patent: Jun. 28, 1988

[54] NET BAG OF EXTRUDED PLASTICS MATERIAL

[75] Inventor: José M. Jordá, Cardedeu, Spain

[73] Assignee: Intermas S.A., Cardedeu, Spain

[21] Appl. No.: 24,305

[22] Filed: Mar. 10, 1987

[30] Foreign Application Priority Data

May 22, 1986 [ES] Spain ..... 294279[U]
Jan. 15, 1987 [ES] Spain ..... 8700102[U]

[51] Int. Cl.[4] ..... B65D 30/06; B65D 33/02; B65D 33/06

[52] U.S. Cl. ..... 383/8; 383/76; 383/77; 383/117

[58] Field of Search ..... 383/8, 77, 102, 117, 383/76

[56] References Cited

U.S. PATENT DOCUMENTS

| | | | |
|---|---|---|---|
| 1,572,605 | 2/1926 | Howe | 383/102 X |
| 2,390,423 | 12/1945 | Carter | 383/117 X |
| 2,511,644 | 6/1950 | Liss | 383/102 |
| 3,482,761 | 12/1969 | Suominen et al. | 383/8 |
| 4,312,392 | 1/1982 | Sekiguchi | 383/8 |

FOREIGN PATENT DOCUMENTS

| | | | |
|---|---|---|---|
| 3300573 | 7/1983 | Fed. Rep. of Germany | 383/117 |
| 405057 | 7/1966 | Switzerland | 383/8 |
| 2021069 | 11/1979 | United Kingdom | 383/7 |
| 2077221 | 12/1981 | United Kingdom | 383/8 |

*Primary Examiner*—Stephen P. Garbe
*Attorney, Agent, or Firm*—Bell, Seltzer, Park & Gibson

[57] ABSTRACT

An extruded plastics material net bag, formed by a tubular body which in the flattened state defines two superimposed sheets, in each of which there are two reinforced longitudinal lateral web portions close to the lateral edges of the bag and a reinforced longitudinal central web portion substantially equidistant between the other two; the bag handles are extensions of the lateral web portions and are provided with a weld line at the end thereof while a weld line defines the bottom of the bag. The bag is closed either by way of a filiform member capable of throttling the mouth of the bag or by two closing appendices, one on each sheet and which extend beyond the bag mouth, being joined together by knotting, stapling or any other means. The special location of the lateral web portions and the existence of the central web portion provide more strength and a greater dimensional stability to the full bag.

1 Claim, 3 Drawing Sheets

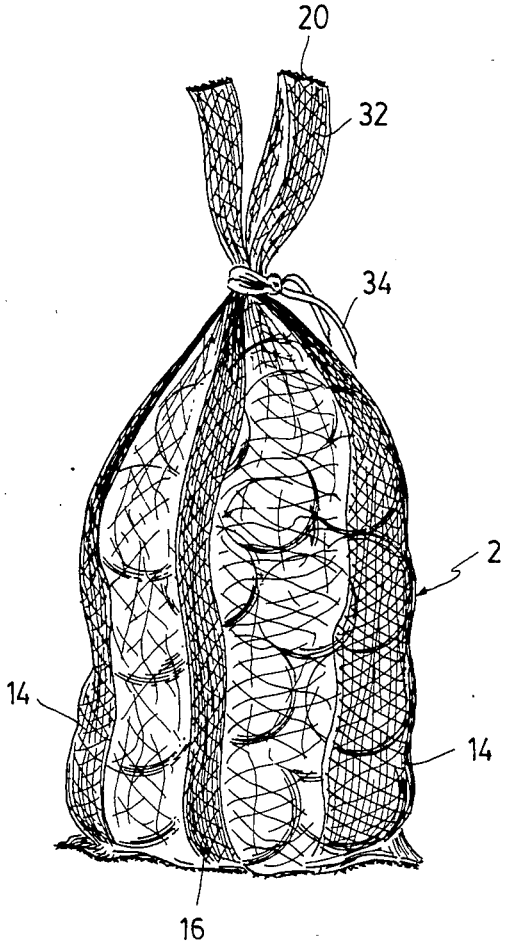
FIG. 3
FIG. 4
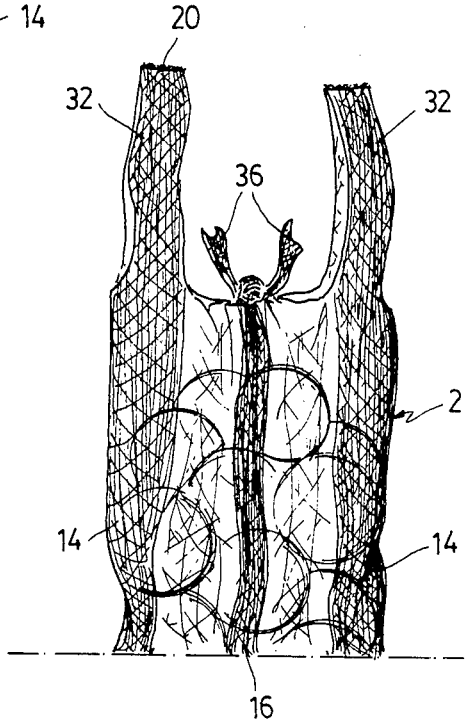

NET BAG OF EXTRUDED PLASTICS MATERIAL

BACKGROUND OF THE INVENTION

1. Field of the Invention

This invention relates to a net bag of extruded plastics material having a tubular body provided with a net structure formed by strands arranged in a plurality of bundles of parallel strands. In flattened form, said body has a width, defines lateral edges of the bag and forms two superimposed sheets provided with reinforced longitudinal web portions, in which the strands of the net structure are packed more densely than in the rest of the body, there being interstices between the strands of said web portions keeping them permeable, there being also a bag bottom defined by a weld line joining said two sheets together, the bag being provided with two handles integrally formed with the tubular body, each of said handles being formed by a half handle and by a further half handle extending from a reinforced web portion of the other sheet, said half handles being joined together by a line of welding at the end thereof, each handle having an outer lateral edge and an inner lateral edge, a mouth of the bag being defined between the said inner edges.

2. Description of the Prior Art

Bags of this type are known and provide numerous advantages over other types of bag. Nevertheless, the regularly known arrangement of the reinforced web portions has drawbacks relative to the ease of machine filling of the bags and to the deformability of the bag.

SUMMARY OF THE INVENTION

These drawbacks are overcome by a bag of the type decribed above wherein each of the superimposed sheets is provided with two reinforced lateral web portions, each of which starts close to the nearest lateral edge of the bag, said two lateral reinforced web portions being spaced apart over a distance approximately equal to half the width of said body, thereby providing a wide mouth to the bag and wherein there is provided a central reinforced web portion, generally equidistant from the lateral reinforced web portions.

According to a further feature of the invention, the bag is provided with a filiform tape or string-like member extending near the bag mouth through various interstices of the net structure.

Alternatively, according to the invention, each of said superimposed sheets is provided with a closing appendix extending from the bag body, which comprises said central reinforced web portion and is located between the two half handles of the sheet, said appendices being adapted to help to close the bag mouth by being connected one to the other by knotting, stapling or other means.

BRIEF DESCRIPTION OF THE DRAWINGS

Hereinafter simply as illustration without limitative nature there are described preferred embodiments of the invention, with reference to the accompanying drawings, in which:

FIG. 3 is a perspective view of a closed, full bag, of the embodiment of FIG. 1.

FIG. 4 is a part perspective view of a closed, full bag of the embodiment of FIG. 2.

DESCRIPTION OF THE PREFERRED EMBODIMENTS

Figure 1:
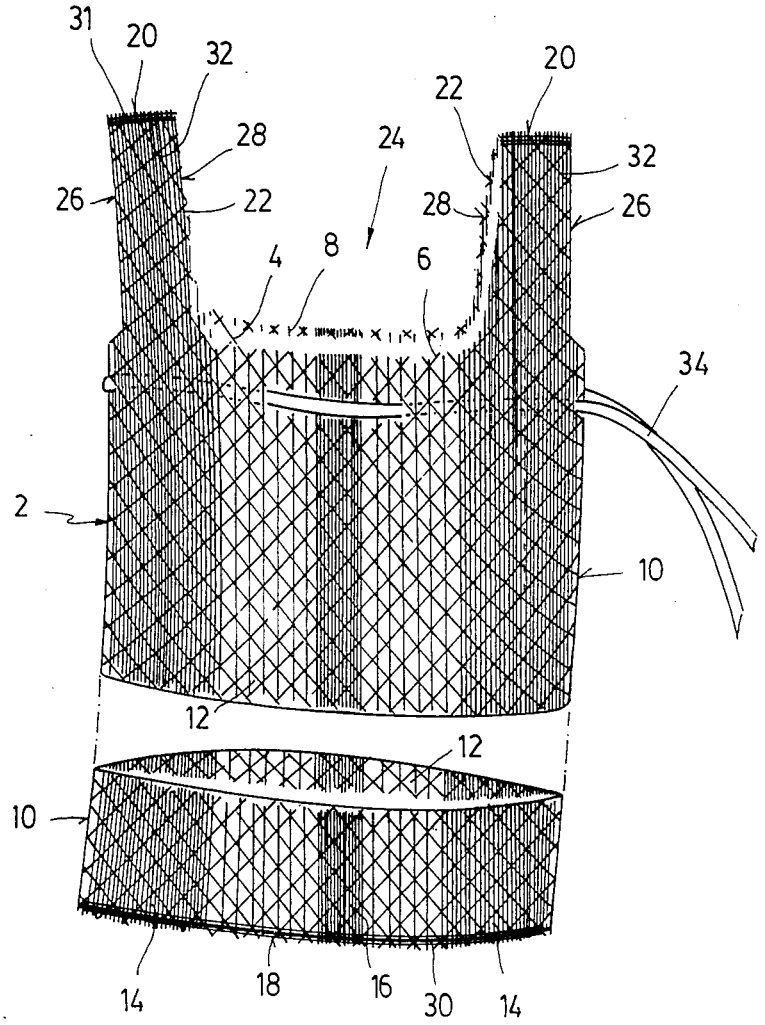
FIG. 1 is a perspective view of one embodiment of the extruded plastics net bag of the invention, showing the two sheets of the bag slightly separated; in the figure, for greater clarity, the illustration of a transverse zone has been omitted, allowing the cross sectional shape of the bag to be seen. It is also pointed out that, in spite of the net nature of the bag, at no time have the parts or sheets of the bag which appear covered in the drawing by other parts of the bag been drawn.

The bag is formed by a tubular body 2 of plastics material having a net structure produced by extrusion. This net structure comprises strands 4, 6, 8 which may form two or more bundles of parallel strands. Thus, in the non-limitative embodiment illustrated in the Figure, there is a first bundle of parallel strands 4 disposed obliquely to the bag, a second bundle of parallel strands 6, also disposed obliquely but with a different orientation to that of the first bundle and finally a third bundle of strands 8 disposed in the longitudinal direction of the bag.

The body 2, in the flattened state thereof, defines lateral edges 10, the distance therebetween being the width of the flattened bag. In said flattened state there are defined two sheets 12 which are superimposed one upon the other.

Each sheet 12 of the bag is provided with reinforced longitudinal web portions 14, 16 in which the strands forming the net structure form a denser mesh than in the remaining portions of the bag body. Nevertheless, between the strands of said web portions 14, 16 there are provided interstices (i.e. one strand is not juxtaposed to another) and therefore said web portions are permeable. In this preferred embodiment illustrated, the greater net density of the web portions 14, 16 is provided by providing more stands 8 dispensed in the longitudinal direction of the bag.

The respective web portions 14, 16 of each sheet 12 of the bag mate, such that they are generally superimposed one upon the other.

The web portions 14 are lateral and start in the proximity of the nearest lateral edge 10 of the bag body 2; they are spaced apart in the bag structure over a distance approximately equal to half the width of the body 2 defined as the distance between the lateral edges 10 thereof. Generally equidistant from the lateral web portions 14, there is the central reinforced web portion 16.

The bag is produced from a tubular arrangement of the plastics material net structured body of indefinite length. The said arrangemnt is cut straight across transversely to provide the bottom edge 18 of the bag at the same time as it provides the upper edge 20 of the half handles of the immediately following bag.

In the embodiment of FIGS. 1 and 3, there is also die cut a wide central space from said upper edge, thereby forming the bag mouth 24 and the shaping of the half handles 22 is started. Said shaping is terminated with lateral die cuts on the lateral edges 10 of the bag, whereby the outer lateral edges 26 and the inner lateral edges 28 of the half handles 22 are delimited. In turn, a line of heat weld forms the bottom of the bag while a line 31 of heat weld forms the connection between the half handles 22 to form each final handle 32.

From the foregoing it will be understand that the bag is extremely simple to manufacture, thus resulting in its low cost.

The present bag provides notable advantages over the bags having the longitudinal reinforced web portions in form of a compact tape. In such case, it is not possible to seal the bag bottom by welding, since if the welding operation is sufficiently energetic to cause the joining of the superimposed reinforced web portions, it is too strong for the remainder of the bag and damages the net structure; and if the weld is gentle so as not to damage the net structure, it is insufficient to join the reinforced web portions together. Therefore, the bottom end of the prior art bags had to be closed by sewing or any other operation than heat welding.

However, in the bag according to the invention, a heat weld not damaging the less dense portions of the mesh and providing an effective connection both in the denser portions of mesh and in the other portions is quite possible. It is obvious that in this case the automated manufacture of the bags is notably facilitated.

Furthermore, the bag produced by the arrangement in question does not have impermeable web portions, whereby there is avoided the risk that any delicate fruit contained therein may perish for lack of sufficient aeration as a result of being a long time in contact with an impermeable web portion of the bag.

Also, the longitudinal web portions 14, 16 provided in the bag do not represent a thickening of part of the faces ofthe bag, contrarily to what usually happens when the reinforced web portions are made from a suprimposed material. This difference avoids the possibility of erosion of the produce contained in the bag due to such thickening.

As may be seen in the figure, the half handles 22 form extensions of the reinforced web portions 14, whereby there is obtained the advantage that the stress that the bag has to withstand when hung up or held by the handles 32 thereof is applied to a reinforced portion of the bag itself.

In already known embodiments,the web portions 14 and, therefore, the handles 32 are farther removed from the lateral edges 10 of the bag body 2. This arrangement of the web portions means that the bag mouth is small or, at least, inconvenient to use in bag filling operations.

To overcome this drawback, in the embodiment described, the reinforced web portions 14 start immediately adjacent the bag lateral edges 10, whereby the outer lateral edge 26 of each handle 32 is close to the nearest lateral edge 10 or, in other words, to the ideal extension of said edges 10. Since there is a distance of about half the width of the bag (which dimension should not be understood to be defined by narrow tolerances) between the said two web portions 14, the bag mouth 24 is wider, facilitating the filling operations.

Nevertheless, the said space between the two web portions may cause difficulties. The reinforced web portions are, in fact, less formable than the areas having the normal net structure. Therefore, a substantial spacing between reinforced web portions would cause a produce-filled bag to deform, at times to grotesque proportions, losing the appearance of a bag and possibly affecting also its strength.

To overcome this drawback, there is provided the reinforced web portion 16, substantially intermediate and equidistant from the other two web portions 14. The said web portion 16 prevents the above mentiond deformation, maintaining a dimensional stability in the full bag. Furthermore, the weld line 18 forming the bottom is obviously stronger in the portions corresponding to the reinforced web portions, whereby it is also favourable that the weaker portions of the weld should be shorter, since in this way they are closer to the said reinforced portions.

In the embodiment of FIGS. 1 and 3, the bag is closed by a tape or cord-like filiform member 34 which extends transversally close to the mouth 24 of the bag, passing through various interstices of the net structure. When the tape is pulled, the bag is closed by a throttling effect, as illustrated in FIG. 3.

The said filiform member 34 provides for a very efficient closure of the bag; nevertheless, this filiform member 34 has normally to be inserted by hand, whereby the fast continuous bag manufacturing process is interrupted.

Figure 2:
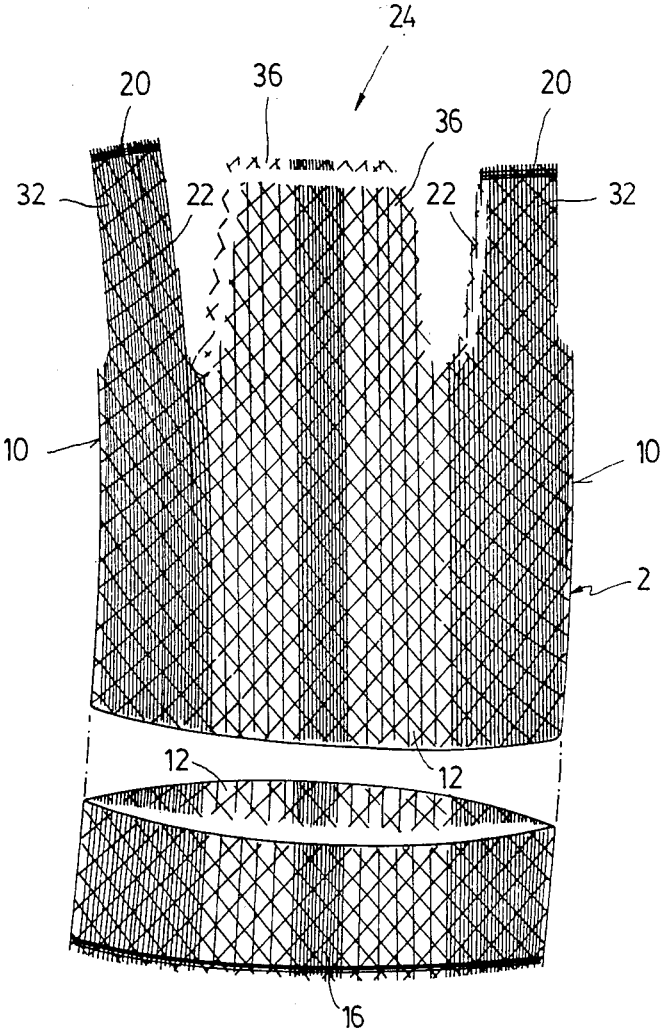
FIG. 2 is a view similar to the previous one, showing another embodiment of the bag.

The above described filiform member is not used in the embodiment of FIGS. 2 and 4. This embodiment is very similar in many ways to the embodiment described above, whereby many reference symbols have been omitted as being common to those of FIG. 1. In this embodiment, each of the superimposed sheets 12, in the flattened state of the bag, is provided with a closing appendix 36 situated between the two half handles 22 of the sheet; the closing appendices 36 comprise the reinforced central web portion 16 and are shorter than the handles 32.

The manufacturing process of the bag embodiment now being described is similar to the previous one, with the difference of the die cutting of the mouth 24, which now forms at the same time the appendices 36; the shorter length of said appendices relative to the handles 32 means that the weld 20 between the half handles 22 does not undesirably weld together the appendices 36. No hand labour is required for the manufacture of this embodiment, such as is required for the insertion of the filiform member.

To close the bag, the closing appendices 36 are knotted together as shown in FIG. 45 or they may be joined together by stapling or by any other means. Particularly in the case where they are knotted together, the presence of the reinforced web portion 16 confers greater strength to the joining of the appendices and at the same time there is achieved an appropriate closing of the mouth, preventing any undesired loss of any of the produce contained therein.

What I claim is:

1. In a net bag of extruded plastic material having a tubular body provided with a net structure formed by strands arranged in a plurality of bundles of parallel strands, said body defining, in flattened form, two superimposed sheets having lateral edges which extend longitudinally and are spaced apart in the width direction, with said bag having a pair of reinforced longitudinal web portions in which the strands of the net structure are packed more densely than in the rest of the body, and in which interstices between the strands of said web portions keep said sheets permeable, and a bag bottom defined by a weld line joining said two sheets together, the bag further having two handles integrally formed with the tubular body, with each of said handles being formed by a half handle extending from a reinforced web portion of one sheet and a further half handle extending from a reinforced web portion of the other sheet, said half handles being joined by a line of welding at the end thereof, with each handle having an outer lateral edge and an inner lateral edge, and with the inner lateral edges of said two handles defining a mouth of the bag therebetween, said pair of reinforced web portions extending longitudinally along and immediately adjacent respective ones of said lateral edges and being spaced apart over a substantial portion of the width of said body thereby providing a relatively wide mouth to the bag, and each of said sheets further including a central reinforced web portion extending longitudinally and centrally between said pair of reinforced web portions, and wherein each of said superimposed sheets includes an integral closing appendix extending longitudinally from the bag body, with each of said appendices comprising an extension of said central reinforced web portion and being located between said two handles of the bag, and with said appendices being adapted to close the bag mouth by being connected one to the other by knottinng or the like.

* * * * *

UNITED STATES PATENT AND TRADEMARK OFFICE

CERTIFICATE OF CORRECTION

PATENT NO. : 4,753,538

DATED : June 28, 1988

INVENTOR(S) : Jose Mas Jorda

It is certified that error appears in the above-identified patent and that said Letters Patent is hereby corrected as shown below:

In column 1, line 19, after "handle" insert -- extending from a reinforced web portion of one sheet --.

In column 2, line 38, change "dispensed" to -- disposed --.

In column 4, line 40, change "45" to -- 4 --.

Signed and Sealed this

Eighth Day of November, 1988

*Attest:*

DONALD J. QUIGG

*Attesting Officer*

*Commissioner of Patents and Trademarks*